US005727627A

United States Patent [19]

Squires

[11] Patent Number: 5,727,627

[45] Date of Patent: Mar. 17, 1998

[54] WELL ROD CENTRALIZER/CENTRALIZER STOP INTERFACE WITH WEAR REDUCING SURFACE

[75] Inventor: Andrew Squires, S.W. Calgary, Canada

[73] Assignee: FCE Control Flow Equipment Ltd., Edmonton, Canada

[21] Appl. No.: 421,243

[22] Filed: Apr. 13, 1995

[51] Int. Cl.[6] ..... E21B 17/10

[52] U.S. Cl. ..... 166/241.3; 166/241.4

[58] Field of Search ..... 166/241.3, 241.4, 166/241.2, 241.1; 175/325.3

[56] References Cited

U.S. PATENT DOCUMENTS

| | | | |
|---|---|---|---|
| 3,104,134 | 9/1963 | Nielsen et al. | 175/325.3 |
| 4,182,537 | 1/1980 | Oster | 166/241.3 |
| 4,606,417 | 8/1986 | Webb et al. | 175/325.3 |
| 4,757,861 | 7/1988 | Klyne | 166/241.3 |
| 5,247,990 | 9/1993 | Sudol et al. | 166/241.3 |
| 5,339,896 | 8/1994 | Hart et al. | 166/241.1 |

*Primary Examiner*—Hoang C. Dang
*Attorney, Agent, or Firm*—Browning Bushman

[57] ABSTRACT

Improved wear interface surfaces on well rod stabilizers and stabilizer stops. Well apparatus includes a rotary tool in a string of tubing extending into a well hole in the earth and a rod extending to the ground surface through such tubing which is drivingly connected to the tool. Centralizers are used on the rod and are located between a pair of centralizer stops. The stops and centralizers associated therewith having wear interface surfaces and at least one of the wear interface surfaces which abut one another having a material thereon of a hardness in the range of 7 to 10 in Mohs scale of hardness and thereby having a hardness greater than the hardness of abrasive materials likely, during use, to pass through said tubing.

19 Claims, 4 Drawing Sheets

WELL ROD CENTRALIZER/CENTRALIZER STOP INTERFACE WITH WEAR REDUCING SURFACE

FIELD OF INVENTION

This invention relates to well tools and more particularly to improvements to rod centralizers and/or centralizer stops used in applications where the rod is rotated to drive a pump or equipment downhole.

BACKGROUND OF INVENTION

Pumping apparatus is well known for pumping liquids, for example oil, from a well to the surface through a string of tubing. The apparatus includes a rod (or string of rods connected one to the other in end to end relation and herein referred to as a rod) and the rod is located within the tubing. The bottom end i.e. the lowermost end of the rod is connected to the rotor or driveshaft input of any suitable pump. The rotation of the rod drives the pump causing the upward flow of liquid through the tubing.

The rod has centralizers thereon at suitable spacings along the rod and each centralizer is limited in movement by being disposed between a pair of centralizer stops spaced from one another along the rod.

The centralizers of concern herein fit loosely on the rod and the rod itself rotates in a bore hole through the centralizer. The centralizer is free to rotate on the rod and may do so on the bare rod body or on some form of race or sleeve assembly which is molded or placed over the rod. To position the centralizer linearly along the length of the rod it is customary to have centralizer end stops fixed to the rod. These end stops are constructed of metal, plastic, or the like materials and are molded or placed on the rod. The purpose of the end stops is to position each centralizer in a particular linear position along the rod length thus preventing the centralizer from moving linearly beyond its predetermined permitted movement along the rod.

Contact occurs between the opposing end faces of the centralizer and the centralizer stop. This may be referred to as a wear interface. The wear interface of the centralizer and the centralizer stop is subject to abrasive wear as the centralizer stop, which is attached to the rod, is in rotational movement while the centralizer itself normally remains stationary. The problem is aggravated when these centralizers are utilized in environments in which the production fluid contains abrasives such as sand particles or like. The wear at the subject wear interface in such instance can be very rapid.

SUMMARY OF THE INVENTION

In accordance with the present invention wear at the interface is reduced by making one or both engagement surfaces out of materials that are as hard as or harder than the abrasive causing the wear. The broad concept of the present invention is to line, coat or apply a layer or a wafer to one or both of the contact surfaces which contains a material that is as hard or harder than the abrasives encountered. In the case of sand particles material such as ceramic or diamond is utilized. By hardfacing both of the surfaces in question wear is reduced as any abrasives that enter the interface region would be crushed and ground to a powder. In the case of only one surface being hardfaced some of the abrasive particles will become embedded in the other opposing surface and after time in use the hardfaced surface will polish or smooth the abrasive particles in the other surface resulting in a low friction hard wear surface itself.

LIST OF DRAWINGS

The invention is illustrated by way of example in the accompanying drawings wherein.

Figure 2A:
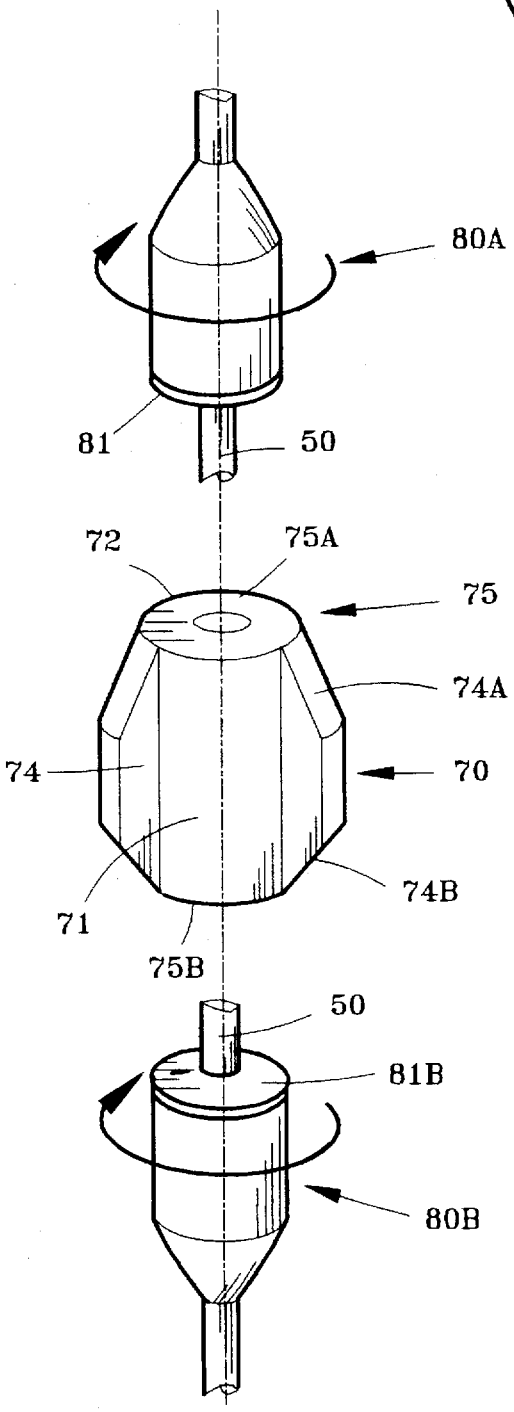
FIG. 2A is an enlarged view of portion of the string rod and stabilizer and stabiliser stops shown in FIG. 1.
Figure 2C:
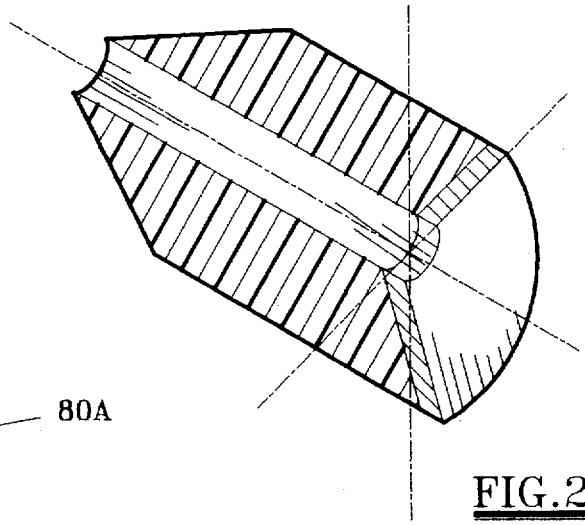
FIG. 2C is a pictorial cross-sectional view of the stop 80A shown in FIG. 2A.
Figure 2B:
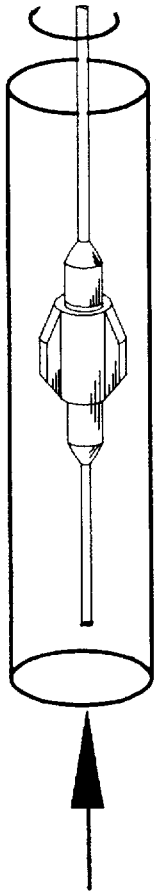
FIG. 2B is a simplified pictorial view of a centralizer positioned within a tubing.
Figure 2D:
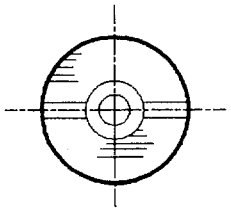
Figure 2E:
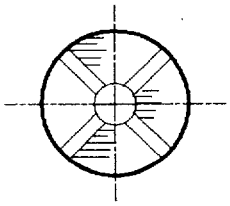
Figure 2F:
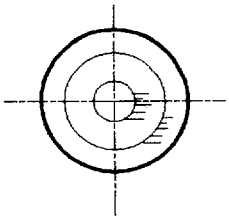
Figure 3:
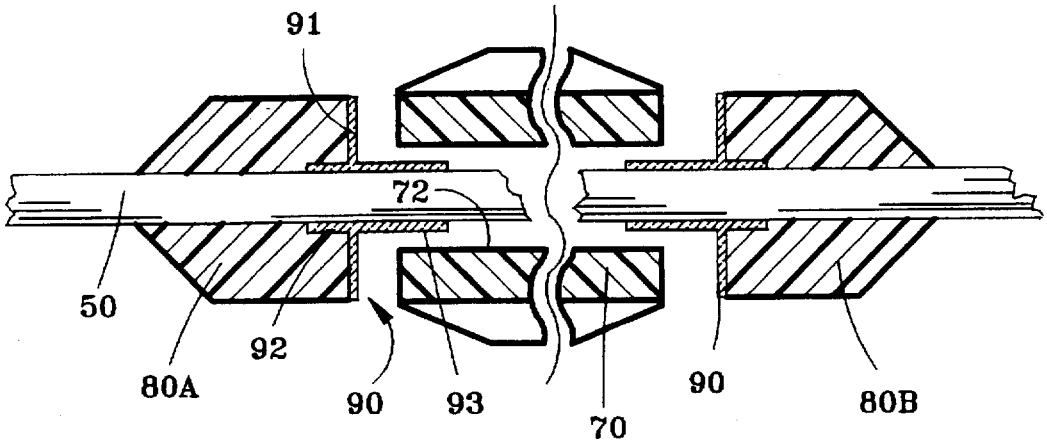
Figure 4:
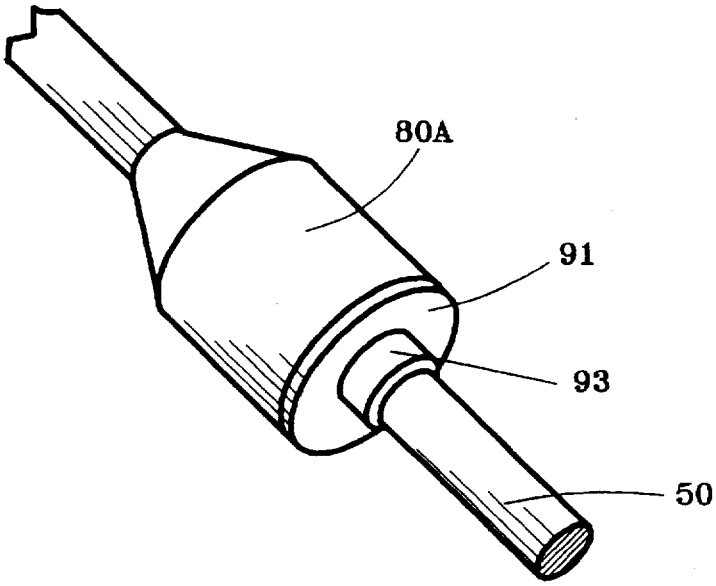
Figure 5:
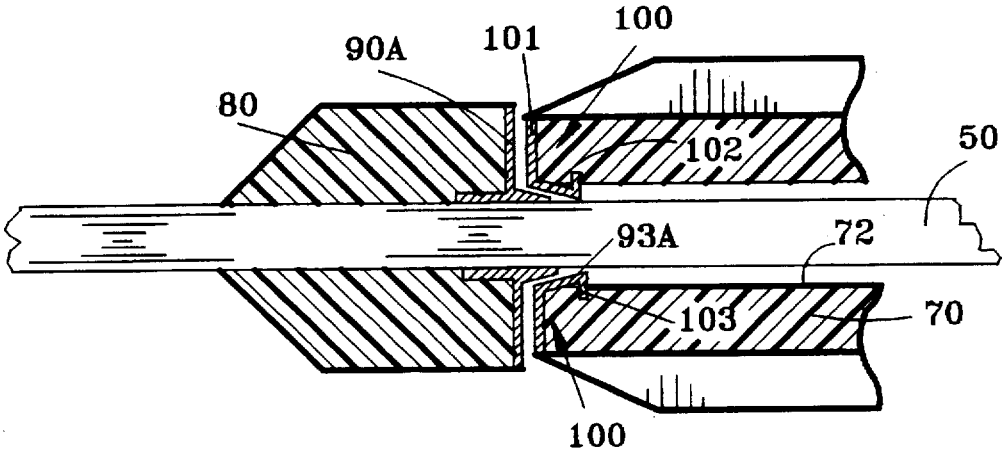
Figure 6A:
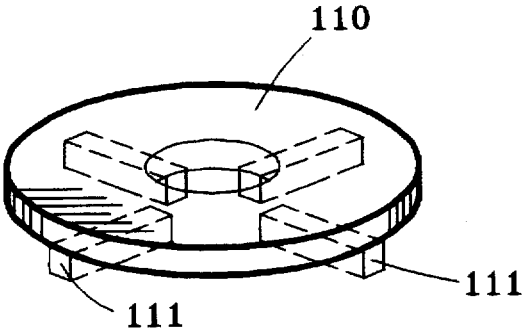
Figure 6B:
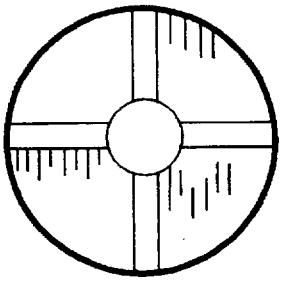
Figure 6C:
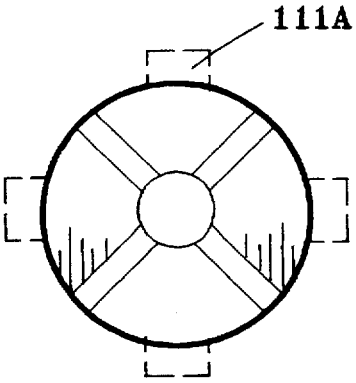

FIGS. 2D, 2E, and 2F are each end views of alternative configurations for the end face of one of the stops shown in FIG. 2A;

FIG. 3 is a part sectional view illustrating another embodiment;

FIG. 4 is an oblique view of one of the rod stabilizer stops of FIG. 3;

FIG. 5 is a partial sectional view of a portion of a rod stabilizer and stop of another embodiment;

FIG. 6A is an oblique view of a wafer of hard material on one face and lugs on the other face for gripping an end face of a rod stabilizer;

FIG. 6B is a top plan view of the stabilizer with grooves to receive the wafer lug; and FIG. 6C is a top plan view of a centralizer stop with notches to receive lugs of another wafer as shown in FIG. 6A.

DESCRIPTION OF PREFERRED EMBODIMENT

Figure 1:
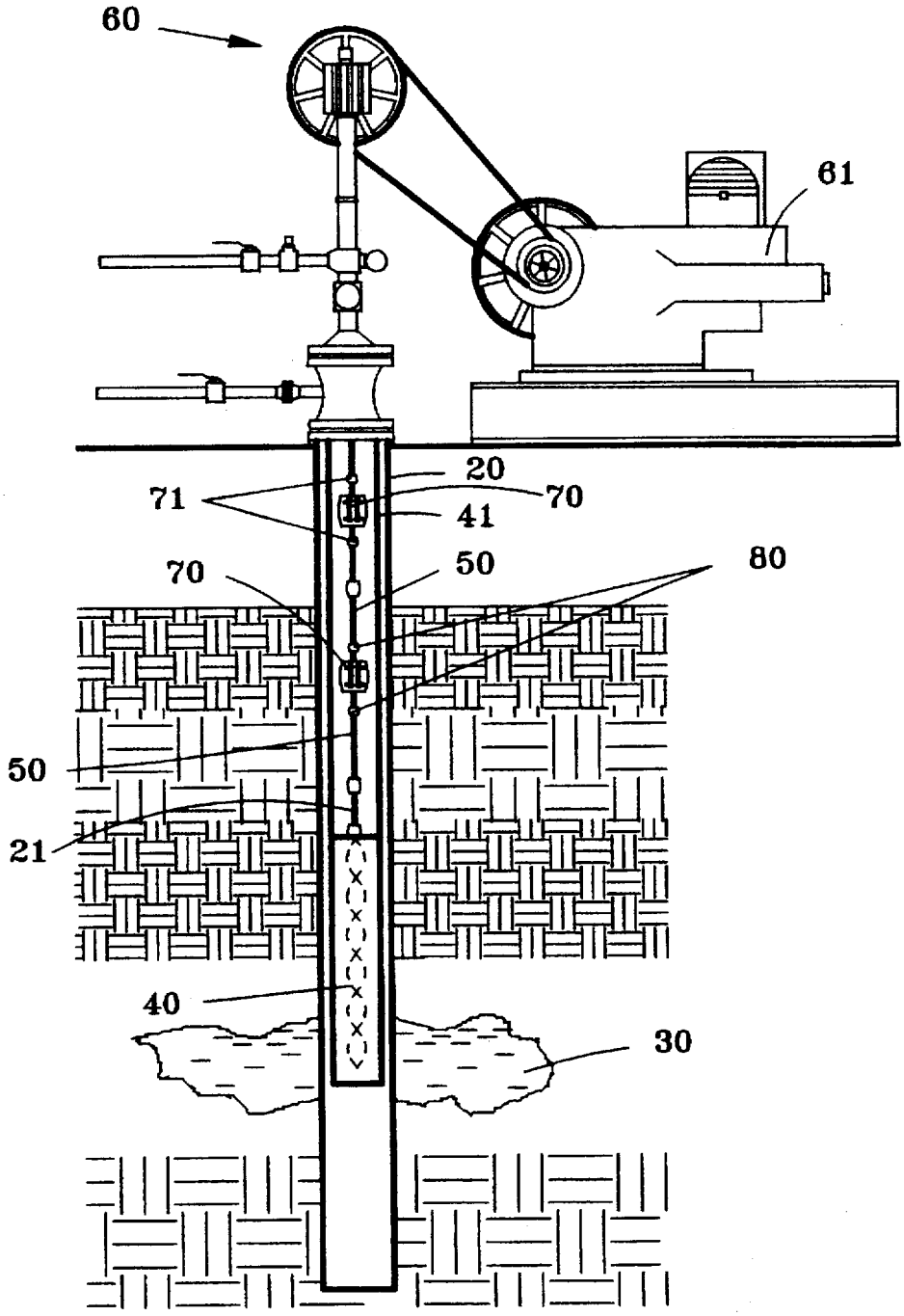
FIG. 1 is a diagrammatic, partial sectional elevational view of a well pumping system incorporating the present invention.

Illustrated in FIG. 1 is a well casing 20 extending downwardly into the ground into a production fluid 30. This production fluid is pumped above ground by a pump unit 40 located in a string of tubing 41 within the casing 20. The pump is operated by a rod 50 driven to rotate about its longitudinal axis (herein vertically disposed) by a driver 60 driven by a motor 61.

On the rod 50 there are a plurality of rod centralizers 70, each located between a pair of spaced apart centralizer stops 80 fixedly secured to the rod 50. The stops are made of a 33% glass fiber reinforced polyphthalamide (PPA) or PPA (filled or unfilled, polyphenylene sulfide (PPS) containing any one of a number of different fillers or Nylon™ or Nylon™ filled fibre (NFF).

FIGS. 2A and 2C respectively show, in exploded and broken perspective, one of the centralizers 70 and a portion of the rod 50 with stops 80 in which the top stop is designated 80A and the bottom stop designated 80B. Top and bottom in this description are respectively stops above and below a centralizer disposed between such pair of stops.

The centralizer 70 has a cylindrical body 71 with a through bore 72 slightly larger in diameter than the rod 50 whereby the rod 50 is readily rotatable relative to the centralizer. The cylindrical body 71 has a plurality of ribs 74 projecting outwardly therefrom. The ribs 74 are spaced apart from one another circumferentially around the body and are parallel to the longitudinal axis of the rod 50. The ribs 74 have respective opposite tapered ends 74A and 74B. During pumping fluid flows through the channels located between the ribs. The centralizer may in some instances have a longitudinal slot extending from one end to the other and at an angle to the longitudinal axis of the rod for ease of placement of the centralizer on the rod in the field.

In the embodiment illustrated in FIG. 2A the centralizer 70 has a top end 75 with a hardened surface 75A that comes into abutment with the bottom end 81 of the stop 80A. Such bottom end of stop 80A and the top end 75 are each coated with a material that is harder than the material of centralizer/centralizer stop associated therewith, for example, bort (diamond), ceramic or oxide or cemented carbides. Common abrasive materials are aluminum oxide, silicone carbide and diamond grit and for grinding flint, garnet, emery and corundum are commonly used.

Sand particles are mainly quartz which, in Mohs scale of hardness, have a hardness of 7. Materials which are harder are topaz (8), sapphire (9), and diamond (10). The selection of materials will depend upon conditions expected to be encountered and while in the broadest aspect the material provides a surface harder than that of the centralizer or centralizer stop as the case may be such surface preferably has a hardness in the range of 7 to 10.

The bottom stop 80B has an upper face 81B that engages the bottom surface 75B of the centralizer. The surfaces 81B and 75B also have surfaces of wear resistant material made, preferably of a material such as ceramic or diamond, sufficiently hard as to grind quartz and other particulate material that may be transported in the production fluid as it is pumped to the surface.

FIGS. 3 and 4 illustrate an embodiment in which a ceramic insert 90 is attached to the lower face of the upper or top centralizer stops 80A and a similar ceramic insert 90 is attached to the upper face of the lower stop 80B. These inserts engage or abut respectively the upper and lower surfaces of the centralizer body. In this embodiment particulate material that becomes embedded in the end faces of the centralizer body is ground to a smooth surface by the ceramic insert (or other abrasive material on the inserts such as diamond grit) leaving embedded particles of quartz in the centralizer body that are ground to a flat finish and thereby become a hardened surface during use.

Each insert 90 has an annular plate portion 91 on the face of the stop member, a sleeve 92 that projects into the stop providing a secure anchor thereto and a sleeve portion 93 that projects into the bore 72 through the centralizer.

FIG. 5 illustrates an alternative embodiment to the shape of the insert of hard material such as for example ceramic and an embodiment wherein there is an insert on each of the centralizer stop and the centralizer body.

Referring to FIG. 5 there is an insert 90A similar to insert 90 of FIG. 4 but where the sleeve projecting into the bore through the centralizer is tapered as indicated by reference 93A. An insert (ceramic or the like) 100 is secured to the centralizer 70 and has a first flat annular portion 101, a truncated conical sleeve portion 102 and a flange section 103. The flange 103 securely anchors the insert to the rod stabilizer. The lower stop (not shown) and adjacent stop would each have respective ones of a pair of such inserts secured thereto.

In the preferred form of the invention one of the two surfaces that abut one another (i.e. the stop and stabilizer respective ends) is harder than the other and such harder surface may be provided by a ceramic wafer (or wafer of equivalent hard material) fastened by means of for example a high temperature epoxy. The wafer of suitable material may have suitable positioning and/or anchor means such as pins, slots, ridges or combinations thereof to maintain alignment during drying/curing and for added adhesion/stability during use.

FIG. 6A shows a wafer 110 with lugs 111 projecting from the bottom face and which mate with corresponding grooves 111A in an end face of the stabilizer (FIG. 6B) or stabilizer stop (FIG. 6C) as the case may be.

I claim:

1. Well apparatus comprising a rotary tool in a string of tubing extending into a well hole in the earth, a rod extending to the ground surface through said tubing and drivingly connected to said tool, said rod being rotated about its longitudinal axis while driving said tool, centralizers on said rod and a pair of centralizer stops mounted on said rod for each of the centralizers thereon, each pair of centralizer stops being located respectively on opposite sides of a centralizer associated therewith and closely adjacent thereto, said centralizers being located at positions spaced apart from one another longitudinally along the rod, said stops and centralizers associated therewith having wear interface surfaces, at least one of said centralizer stop and centralizer wear interface surfaces which abut one another being provided by a wafer made of a material having a hardness in the range of 7 to 10 in Mohs scale of hardness and thereby being greater than the hardness of abrasive materials likely, during use, to pass through said tubing, said wafer having an annular sleeve projecting therefrom and extending along a portion of said rod.

2. The well apparatus as defined in claim 1, further comprising:

each of said centralizers having a plastic material body;

a wear interface centralizer surface on each of said plastic material bodies having a hardness in the range of from 7 to 10 in Mohs scale of hardness; and a wear interface stop surface on a corresponding one of the centralizer stops for planar engagement with the wear interface centralizer surface and having a hardness in the range of 7 to 10 in Mobs scale of hardness.

3. The well apparatus as defined in claim 2, wherein each of the wear interface centralizer surface and the wear interface stop surface are formed from a ceramic material.

4. The well apparatus as defined in claim 2, wherein at least one of the wear interface centralizer surface and the wear interface stop surface is adhesively bonded to a respective one of the plastic material bodies and the centralizer stops.

5. The well apparatus as defined in claim 2, wherein each of the wear interface centralizer surface and the wear interface stop surface is provided on a respective wafer.

6. The well apparatus as defined in claim 5, further comprising:

a plurality of circumferentially spaced anchor members for anchoring the wafer to a respective one of the plastic material bodies and the centralizer stops.

7. A rod centralizer for use on a rod string connected to down hole equipment in a string of well tubing, said centralizer comprising a body with an end face at each of respective opposite ends thereof, a hole through said body having a diameter slightly greater than the rod on which it is to be used, a plurality of ribs projecting from said body and spaced apart from one another circumferentially therearound providing a plurality of channels through which liquid can flow from one of said ends to the other of the centralizer, a wafer on at least one of said opposite ends, means securing said wafer to said centralizer, said wafer being made of material having a hardness greater than that of the material of said body and a hardness in the range of 7 to 10 in Mohs scale of hardness, said wafer having an annular sleeve projecting therefrom to extend along said rod.

8. A rod centralizer as defined in claim 7 wherein said wafer comprises a thin ceramic wafer adhesively bonded to an end of the body of said centralizer.

9. A rod centralizer as defined in claim 7 wherein said wafer is a ceramic wafer and wherein there is a wafer adhesively bonded to each of opposite ends of said centralizer.

10. The rod centralizer as defined in claim 7, further comprising:

the centralizer body is formed from a plastic material body;

a wear interface centralizer surface on the plastic material body having a hardness in the range of from 7 to 10 in Mohs scale of hardness; and an upper stop and a lower stop each fixed to the rod string to limit axial movement of the centralizer body along the rod string and between the upper stop and the lower stop;

a wear interface stop surface on one of the upper stop and lower stop for planar engagement with the wear interface centralizer surface and having a hardness in the range of 7 to 10 in Mohs scale of hardness.

11. The rod centralizer as defined in claim 10, wherein each of the wear interface centralizer surface and the wear interface stop surface are formed from a ceramic material.

12. The rod centralizer as defined in claim 10, wherein at least one of the wear interface centralizer surface and the wear interface stop surface is adhesively bonded to a respective one of the centralizer body and the stops.

13. The rod centralizer as defined in claim 10, wherein each of the wear interface centralizer surface and the wear interface stop surface is provided on a respective wafer.

14. The rod centralizer as defined in claim 13, further comprising:

a plurality of circumferentially spaced anchor members for anchoring the wafer to a respective one of the centralizer body and the stops.

15. A rod centralizer for centralizing a rod string within wall tubing in a well, the rod string rotating to power a downhole pump, the rod centralizer comprising:

a plastic material body having a hole therethrough with a diameter greater than the rod string;

a plurality of ribs projecting radially from the body and spaced apart circumferentially to provide a plurality of flow channels for liquid passing through the well tubing in response to the downhole pump and past the rod centralizer;

an upper stop and a lower stop each fixed on the rod string to limit axial movement of the plastic material body along the rod string and between the upper stop and the lower stop;

a wear interface centralizer surface on an end of the plastic material body and having a hardness in the range of from 7 to 10 in Mobs scale of hardness; and a wear interface stop surface on at least one of the upper stop and lower stop for planar engagement with the wear interface centralizer surface and having a hardness in the range of from 7 to 10 in Mohs scale of hardness.

16. The rod centralizer as defined in claim 15, wherein each of the wear interface centralizer surface and the wear interface stop surface are formed from a ceramic material.

17. The rod centralizer as defined in claim 15, wherein at least one of the wear interface centralizer surface and the wear interface stop surface is adhesively bonded to a respective one of the plastic material body and the upper stop and lower stop.

18. The rod centralizer as defined in claim 15, wherein each of the wear interface centralizer surface and the wear interface stop surface is provided on a respective wafer.

19. The rod centralizer as defined in claim 18, further comprising:

a plurality of circumferentially spaced anchor members for anchoring the wafer to a respective one of the plastic material body and upper stop and lower stop.

* * * * *

UNITED STATES PATENT AND TRADEMARK OFFICE

CERTIFICATE OF CORRECTION

PATENT NO. : 5,727,627
DATED : March 17, 1998
INVENTOR(S) : Andrew Squires

It is certified that error appears in the above-indentified patent and that said Letters Patent is hereby corrected as shown below:

In col. 4, line 33, change "Mobs" to --Mohs--.

In col. 5, line 36, change "wall" to --well--.

In col. 6, line 14, change "Mobs" to --Mohs--.

Signed and Sealed this

Fourteenth Day of July, 1998

Bruce Lehman

*Attest:*

BRUCE LEHMAN

*Attesting Officer*

*Commissioner of Patents and Trademarks*